United States Patent [19]

Vokes

[11] 4,129,259

[45] Dec. 12, 1978

[54] APPARATUS FOR PULPING WASTE PAPER MATERIALS

[75] Inventor: Robert F. Vokes, Whispering Pines, N.C.

[73] Assignee: The Black Clawson Company, Middletown, Ohio

[21] Appl. No.: 833,483

[22] Filed: Sep. 15, 1977

[51] Int. Cl.[2] ..... B02C 23/36

[52] U.S. Cl. ..... 241/20; 241/21; 241/46.17; 209/250; 209/281

[58] Field of Search ..... 241/46.11, 46.17, 79, 241/79.1, 79.2, 20, 21, 24; 209/250, 273, 281

[56] References Cited

U.S. PATENT DOCUMENTS

| | | | |
|---|---|---|---|
| 2,133,974 | 10/1938 | Cowles | 209/273 |
| 3,259,244 | 7/1966 | Kaljo et al. | 209/281 |
| 3,549,092 | 12/1970 | Baxter | 241/46.17 |
| 3,698,649 | 10/1972 | Herbert | 241/79.2 |
| 3,815,740 | 6/1974 | Ginaven | 209/281 |
| 3,960,332 | 6/1976 | Seifert | 241/46.06 |
| 4,030,671 | 6/1977 | Couture | 241/46.17 |

*Primary Examiner*—Granville Y. Custer, Jr.
*Attorney, Agent, or Firm*—Biebel, French & Nauman

[57] ABSTRACT

Recovery of paper fiber for reuse from waste paper materials containing plastic sheet and film is facilitated by the combination of a pulper in which the waste paper materials are pulped in a pulper equipped with a junk remover connected with the bottom of the pulper tub by a chute and provided with a recycling circuit by which the plastic and other lightweight trash picked up by the conveyor buckets in the junk remover is removed from the pulping system, passed through a detrasher for removing bulky objects, then passed through a deflaking station, and then returned to the pulper tub for further defibering. This continuous withdrawal of liquid from the junk remover and its return to the tub act to maintain the hydrostatic head in the tub at a higher effective level than in the junk remover tower and thereby to promote transfer of the plastic and other lightweight trash to the junk remover for removal by the recycling circuit.

10 Claims, 5 Drawing Figures

APPARATUS FOR PULPING WASTE PAPER MATERIALS

BACKGROUND OF THE INVENTION

This invention relates to the pulping of waste paper products for recovery of reusable paper making fibers therefrom, and especially to improvement of such pulping operations from the standpoints of both efficiency and high quality of yield.

A problem of increasing magnitude in the pulping of waste paper products has been the steady increase in the amount and nature of the contaminants mixed therewith in commercially obtainable waste paper, the contaminants now commonly averaging of the order of 15% by weight. Of particular importance is the amount of lightweight contaminant junk, primarily in the form of plastic products of many kinds and especially plastic sheet and film and also pieces of plastic foam.

In the past, many of the common contaminants of waste paper could be eliminated from the pulper tub by the use of a junk remover, a typical example being shown in Baxter U.S. Pat. No. 3,549,092. Such a junk remover relies on gravity discharge through a downward chute from the pulper tub of iron and other junk material of substantially higher specific gravity than paper fibers. But such junk removers have proved to be ineffective for removing lightweight junk, for two principal reasons.

One reason is the obvious one that material lighter than water will not readily flow down the chute which connects a pulper tub with its junk remover. The other is that the normal operation of a pulper rotor tends to force sufficient liquid from the tub to the junk remover when the pulping operation commences to maintain a higher static head in the junk remover than in the tub, commonly of the order of two or more feet. Further, the common practice is to add fresh liquid to the tub by way of the junk remover, in order to wash fiber back into the tub from the high specific gravity pieces traveling through the chute from the tub, and this increases the opposition to the flow of light materials from the tub.

The result of these conditions is that when a waste paper pulper — whether or not it is equipped with a junk remover — is operated on a continuous basis, with continuous extraction, through a perforate extraction plate, of a slurry of sufficiently small particle size and continuous replacement of water and furnish, plastic tends to accumulate in the tub until the amount of extracted fiber drops below an acceptable rate, a condition which the industry calls "constipated". It is then necessary to discontinue pulping and empty the accumulated junk manually from the tub.

The development of this condition has three significant disadvantages. Running of the pulper until the paper fiber can no longer be extracted not only results in loss of production of recovered paper fiber but also produces increased and unnecessary wear on the pulper rotor and its extraction plate. In addition it results in extraction of a substantial amount of small plastic particles with the paper fiber, as the quantity of plastic in the tub increases to the point where it comes into contact with the rotor, and such small pieces of plastic are difficult to separate from the paper fiber, especially if the holes in the extraction plate are small. At the same time, manual emptying of accumulated plastic is expensive and time consuming, and it also results in the loss of a substantial amount of fiber which remains commingled with the plastic and is therefore eliminated along with the plastic.

U.S. Pat. No. 4,030,671 issued June 21, 1977 to Joseph Walter Couture taught that these disadvantages of past practice can be overcome, and the effectiveness of a junk remover greatly improved, by maintaining the liquid level in the junk remover lower than in the pulper tub and thereby inducing liquid flow from the tub into the junk remover. In accordance with that patent, this is done by connecting the inlet of a pump to the junk remover casing at a level below the minimum operating level in the tub, and withdrawing liquid from the junk remover and recirculating it back to the tub under controlled conditions establishing the desired lower liquid level in the junk remover than in the tub, e.g. lower by about a few inches.

The effect of this removal of the normal static head conditions is first to induce flow through the chute from the tub into the junk remover. Lightweight trash circulating in the tub will be entrained in that flow, and as soon as it enters the junk remover, it will rise to the top and thus be trapped against return to the tub. The resulting accumulation of lightweight trash at the top of the liquid in the junk remover is lifted out for removal by the perforated conveyor buckets which are standard equipment in a junk remover.

The system of the Couture patent has proved to be so effective in one commercial installation, handling commercial waste paper containing approximately 15% trash, that the pulper operated continously at practical extraction and horsepower rates when the recirculating pump was operated for only two 15-minute periods during each 8-hour shift. In this same installation, prior to application of the invention thereto, the junk remover had been so ineffective in eliminating lightweight trash that its use for that purpose had been discontinued.

The system of the Couture patent, however, has proved to be almost too effective in another installation, in the sense that the plastic sheet material accumulated so rapidly in the collection box into which conveyor buckets dumped that its removal from the collection box became a practical problem. In addition, the rapidly accumulating lightweight trash included or carried with it an undesirably large proportion of good fiber and still undefibered pieces of recoverable paper material. There is also a possibility in the Couture system that the inlet of the recirculating pump may be plugged by very large pieces of junk or undefibered waste paper or board. The present invention was developed to take care of such situations, as described hereinafter.

SUMMARY OF THE INVENTION

The essence of the present invention lies in the provision of a system operating in combination with a pulper and junk remover wherein the plastic and other lightweight trash picked up by the junk remover conveyor is continually removed, along with sufficient liquid to carry it from the junk box, and this flow is treated to effect maximum separation of contaminants from reusable fiber before returning the latter to the pulper for further defibering action. In addition, provision is made in accordance with the invention for separating large pieces of lightweight trash, such as chunks of wood and the like, from the reject flow out of the junk remover before the remaining flow is treated to separate the plastic sheet from the reusable fibrous contaminants.

In accordance with the invention, the conveyor buckets in the junk remover are caused to dump their contaminants into a junk box which is continually filled with liquid to a sufficient level to float lightweight trash over a weir leading to a hopper. Detrasher means, in the form of very coarse straining means, such as a grid of tine-like members, is positioned in the path of the overflow from the weir into the hopper, with the tines being so spaced with respect to each other, and at such angle to the horizontal, that they will permit the passage of most of the plastic sheet and similar contaminant material but will shunt large pieces of floating trash, such particularly as chunks of wood or plastic, to a separate receiver.

The material passing through the detrasher grid may be returned directly to the pulper tub for further defibering, or may first be subjected to a deflaking operation, which may be done by a pump capable of such action or by a deflaker in conjunction with a pump capable of handling a fluid flow containing substantial quantities of solids. The output of the deflaking section of the system is then preferably screened to reject large plastic pieces and the like, with the accepts flow from such screening being returned to the pulper tub for further defibering.

The system of the invention as thus briefly outlined differs from the system of the Couture patent in that it does not employ a separate pump for directly recirculating liquid from the lower portion of the junk remover to the tub to induce the flow of liquid and suspended light rejects to the junk remover. Instead, the system of the invention recirculates liquid continuously from the junk box in the junk remover back to the tub in one or more of several other ways which accomplish the desired result of controlling the relative liquid levels in the tub and the junk remover tower to effect maximum continuous removal of lightweight trash with minimum loss of reclaimable fiber.

One of these ways of effecting the desired recirculation is by overflow from the junk box in the top of the junk remover tower to the detrasher, with this overflow liquid being recycled directly to the tub with the accepts from the detrasher, or from the deflaker if one is used. Another recirculating means is an overflow connection from the junk remover tower directly to the tub which will tend to equalize the liquid levels in the tub and tower. In addition, the normally higher level in the tower will tend to cause backflow to the tub through a different level in the connecting chute from the outflow to the tower which is caused by the pumping action of the pulper rotor and constitutes the main force for initially delivering lightweight trash to the tower.

DESCRIPTION OF THE PREFERRED EMBODIMENTS

Figure 1:
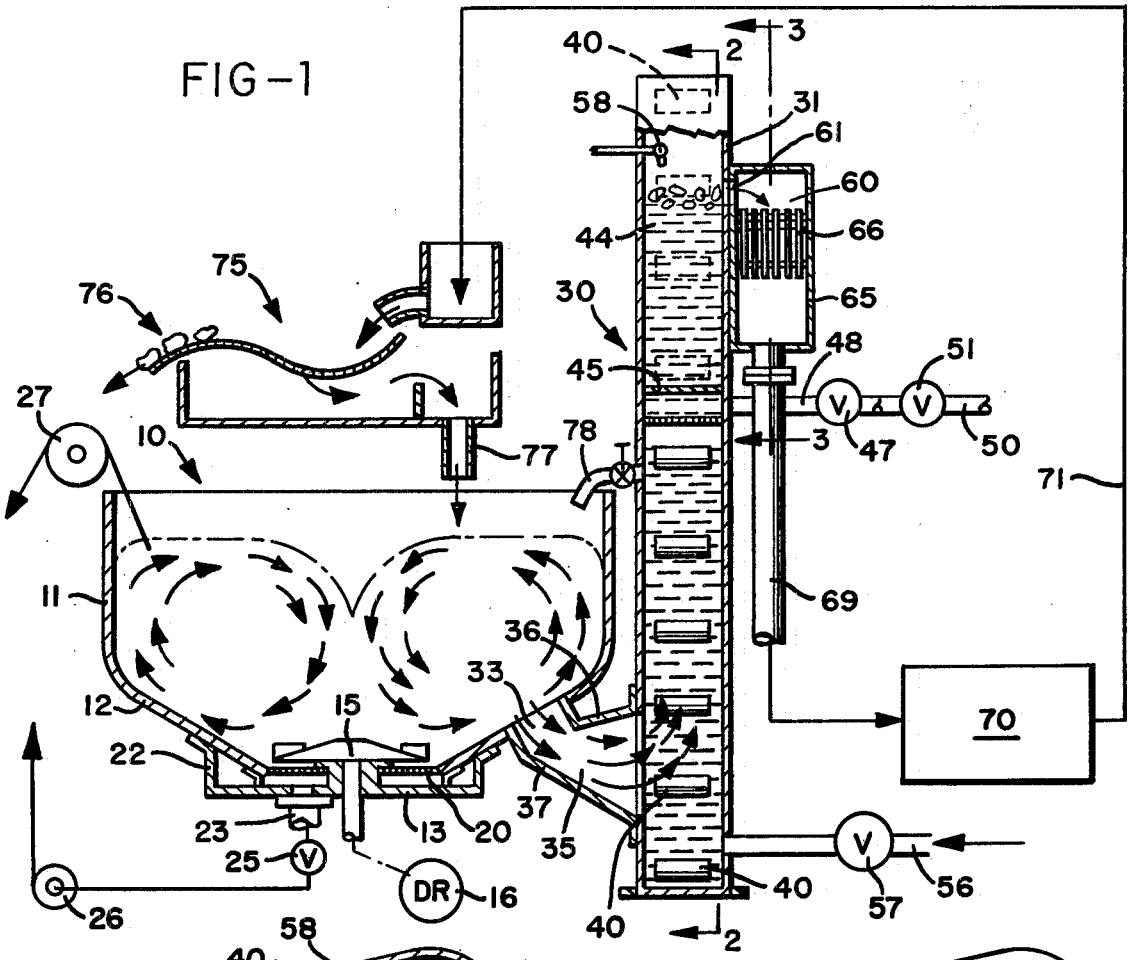
FIG. 1 is a somewhat diagrammatic view generally in vertical section showing a pulper and junk remover incorporating means for practicing the invention.

In FIG. 1, the pulper 10 is generally of the construction disclosed in Felton-Vokes U.S. Pat. No. 3,339,851, and includes a cylindrical upper wall 11, an inwardly tapered lower wall portion 12, and a bottom wall 13. The rotor 15 is mounted for rotation on a vertical axis in the bottom of the tub and has a drive 16. A perforated extraction plate 20 positioned under the rotor 15 defines with the bottom wall 13 a chamber 22. For preferred results, the extraction plate 20 has relatively small perforations, e.g. ⅛ to 3/16 inch in diameter, and a discharge line 23 provided with a control valve 25 conducts stock extracted through plates 20 from chamber 22 to a pump 26 and the next station in the system. Usually, the pulper will be equipped with a ragger, indicated at 27, such as disclosed in Cowles U.S. Pat. No. 2,340,511 for removing materials such as wire and rope from the tub.

The junk remover indicated at 30 is generally of conventional construction and includes a casing or tower 31 higher than the tub 11. The tub includes an outlet 33 in its tapered wall portion 12 from which a chute 35 leads to the junk remover tower 31, the chute 35 preferably having upwardly and downwardly inclined top and bottom walls 36 and 37.

Figure 2:
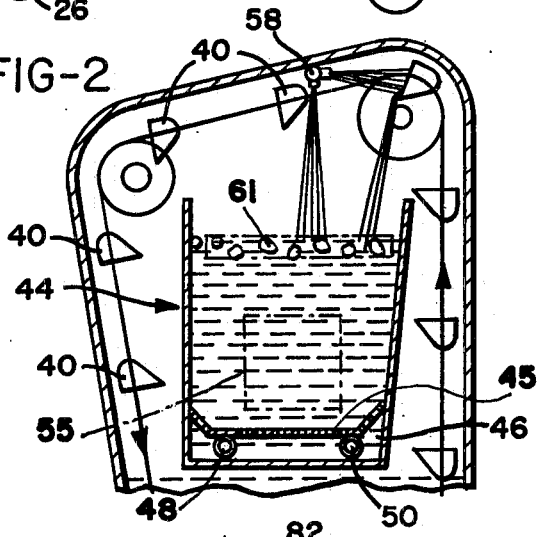
FIG. 2 is a diagrammatic view generally on the line 2—2 of FIG. 1 through the junk remover.

The junk remover 30 is provided with a conveyor comprising a plurality of buckets 40 on endless chains 41. In operation, the buckets 40 collect heavy trash from the bottom of the tower 31 and dump it in a collection box 44 in the upper portion of the tower at a location above the maximum normal liquid level in the tower. The form of collection box 44 shown in FIGS. 1 and 2 has a false bottom 45 comprising a perforate extraction plate through which water and fiber can drain to the chamber 46, and can be emptied by way of normally closed valve 47 and pipe 48. A water supply line 50 having a valve 51 provides for the normal in-flow of water to the box 44 by way of the chamber 46 and the perforations in plate 45. Collection box 44 is provided with a cleanout door 55 for emptying of heavy trash as required, which is readily done by closing valve 51 and opening valve 47.

In normal continuous use of this pulper and junk remover, waste paper products, usually in bale form, are charged into the tub along with enough water to provide a pulpable total solids content, usually about 4—8%. As soon as the pulper has been operating long enough to reduce some of the paper to essentially defibered condition, i.e. to particle sizes which will pass through extration plate 20, the extraction valve 25 is opened to withdraw extracted stock from chamber 22 under plate 20. Additional furnish, i.e. waste paper, and water are added at the rate necessary to maintain the consistency of the suspension in the tub in the desired percentage range.

Commonly, make-up water and/or recycled white water is added to the junk remover, as indicated by the line 56 and valve 57, so that the incoming water will wash fiber away from solid trash in the chute 35 back into the pulper while allowing the heavy junk to continue downwardly into position to be picked up by the conveyor buckets 40, thus providing a two-way flow of liquid through the chute 35, i.e. trash-carrying liquid impelled by the rotor into the junk remover and relatively solids-free return flow into the pulper tub. This water is advantageously recirculated from a thickening station downstream in the system to which extracted stock is delivered from the pump 26. In addition, either fresh or accumulated white water is supplied as showers at 58 at the top of the junk remover for washing the conveyor buckets as they dump into the collection box 44.

Figure 3:
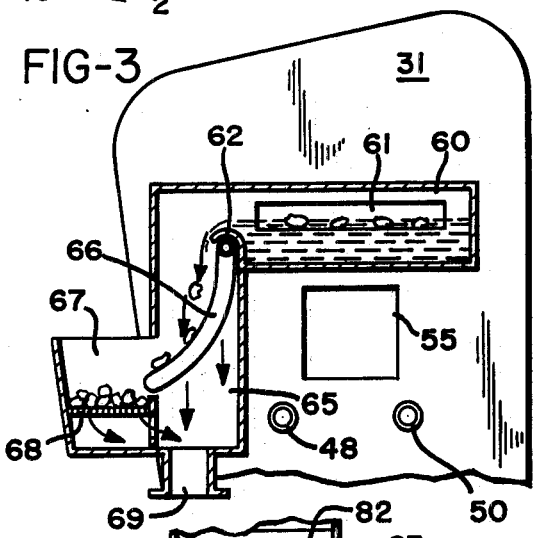
FIG. 3 is a diagrammatic view generally on the line 3—3 of FIG. 1 through the detrasher section.

The means provided in accordance with the invention for effecting continuous removal of lightweight trash from tower 31 includes a supplemental tank 60 of relatively shallow tray-like proportions which forms an extension of the top portion of the junk box through the opening 61 and includes one wall 62 lower than the others to define a weir. In FIGS. 1 and 3, the supplemental tank 60 is mounted exteriorly of the side of tower 31, and a hopper 65 is mounted below and in front of tank 60 to receive liquid overflowing weir 62.

In operation, the conveyor buckets 40 will pick up both heavy and lightweight trash and deposit it in the collection box 44 along with substantial amounts of liquid but in order to assure that the buckets retain the floating trash until dumped, they preferably have some perforations for initial drainage of some liquid before felting over by fiber. The number, size, motion and perforations of the buckets 40, as well as the substitution of other conveyor means in place of the buckets, are all selective in the practice of the invention, with the objective of lifting floating trash to the junk box with a substantial amount of entrained liquid.

All lightweight trash which is collected in the junk box 44 will initially float within the junk box, but since there is a continuous flow over the weir 62, the resulting currents will induce flow of the floating trash into supplemental tank 60 and then over weir 62. This lightweight trash will normally include pieces of undefibered paper, plastic sheet material, and pieces of other trash of substantial sizes, such particularly as chunks of wood, plastic bottles, etc. Continuous flow over weir 62 is aided by directing water against it from showers 58, i.e. by adjusting some of the showers 58 to direct the water discharged therefrom against the weir 62.

One of the purposes of the invention is to eliminate the unreclaimable trash from the system while retaining the maximum amount of reject material which may still have recoverable fiber attached thereto, such as pieces of plastic-coated paper. For this purpose, the supplemental tank 60 and hopper 65 are converted into a detrasher by the addition of a coarse screening mechanism such as a bar screen or comb-like arrangement of elongated tines 66 arranged in laterally spaced inclined relation in the path of the overflow from weir 62 into hopper 65.

The arrangement and spacing of the tines 66 are preferably such that at least the majority of even relatively large plastic sheets will slip between them into the hopper 65, but chunks of wood and other unreclaimable lightweight trash will slide off the upper surfaces of the tines 66 with sufficient momentum to carry them into a supplemental receiving box 67 from which they can subsequently be removed, commonly at intermittent intervals, and which has a perforate bottom 68 through which water can drain into hopper 65 as well as overflow under the lower ends of the tines 66. As an example of a suitable arrangement and proportions for the tines 66, satisfactory results have been obtained with the supplemental tank 60 and weir 62 approximately 15 inches in width, and with five tines each three-eighths inch in thickness and spaced to provide slots 2¼ inches wide therebetween.

The flow delivered into the hopper 65 will include all the lightweight trash and reusable fiber pieces transmitted through the tines 66, and this flow is conducted by a line 69 to a deflaker section represented by the box 70, which may take a variety of forms. For example, satisfactory results have been obtained with a Gorator pump (a commercial product of Dorr-Oliver, Inc.) which can simultaneously pump and deflake a liquid containing a substantial volume of solid material. Alternatively, the station 70 may be only a pump for recycling the accepts from the detrasher to the tub, or it may include a deflaker, such as is disclosed in Seifert U.S. Pat. No. 3,960,332, connected to be supplied with slurry from the line 69 by a pump capable of relatively high volume operation while handling slurries of the solids content to be expected in the operation of the system of the invention, e.g. a WEMCO type pump (a commercial product of Envirotech Corporation, Wemco Division).

The output from the deflaking station 70 is conducted by a line 71 to suitable screening apparatus 75 for rejecting the coarse contaminants which remain in the slurry, as indicated at 76, and recycling the accepted stock at 77 to the pulper 10 for further defibering. The screen 75 may be a vibrating screen of the Jonsson or other conventional type, or a coarse rotary screening apparatus such as is shown in Murphy U.S. Pat. No. 2,060,685.

It will be seen from this description that in the operation of a system in accordance with the invention, provision is made for effecting continuous removal of plastic and other lightweight trash from the pulper by way of the junk remover, and this lightweight trash is prevented from returning to the pulper after it has been effectively separated from the undefibered material which is initially collected with the lightweight trash. The defiberable portion of the removed material is then returned to the system for further defibering thereby assuring the maximum yield of reusable fiber from the initial charge of waste paper furnish.

Operation of the system of the invention as described in inducing the initially needed flow of lightweight trash from the pulper tub to the junk remover is as effective as in the system of the Couture patent if sufficient liquid is continuously recycled by way of the junk box 44 and hopper 65 to counteract the higher liquid head in the junk remover tower as compared with the pulper which normal operation of such a system creates. In other words, by continuously removing a substantial volume of water to the collection box 44 from the tower with the lightweight rejects in the buckets 40 and recycling most of that liquid to the tub, the liquid in the tower can be held at a sufficiently lower level than in the tub to induce continuous flow of lightweight trash into the tower by way of chute 35. This result can also be promoted by the provision of an overflow connection 78 from the tower to the tub which will accomplish sufficient equalization of the operating liquid levels in the tower and tub to achieve the desired result of increased flow of lightweight trash into the tower and minimum return flow thereof to the tub.

Figure 4:
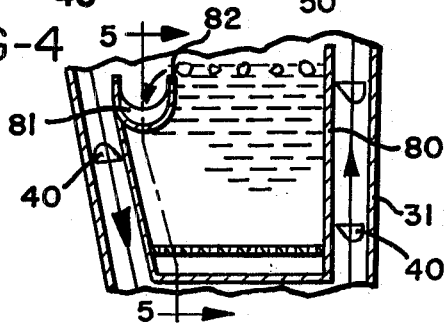
FIG. 4 is a diagrammatic view similar to FIG. 2 illustrating a modification of the arrangement of FIG. 3.
Figure 5:
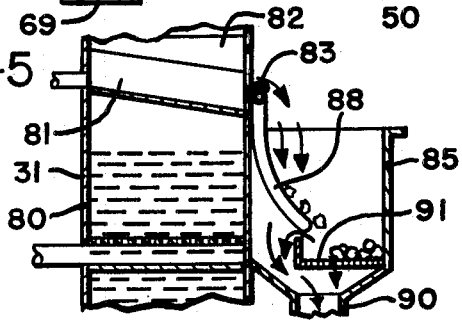
FIG. 5 is a section on the line 5—5 of FIG. 4.

FIGS. 4 and 5 show a modified construction wherein the junk collecting box 80 within the tower 31 has a trough portion 81 along the front thereof into which liquid and lightweight trash will flow over a weir 82. The trough 81 has its bottom downwardly inclined toward the outside of the tower 31 and is provided at its outer end with a weir 83 leading to a hopper 85 and equipped with a tine assembly 88 comparable in structure and function to the arrangement of tines 66. The line 90 in FIG. 5 corresponds to line 69 in FIG. 1, and there is a similar receptacle 91 within the hopper 85 for receiving bulky lightweight trash which slides off the tines 88. Otherwise, the arrangement of FIGS. 4 and 5 is essentially the same as shown in FIG. 1.

While the methods and forms of apparatus herein described constitute preferred embodiments of the invention, it is to be understood that the invention is not limited to these precise methods and forms of apparatus, and that changes may be made therein without departing from the scope of the invention.

What is claimed is:

1. Apparatus for recovering paper making fiber from waste paper products including substantial quantities of plastic film and other lightweight non-paper waste materials, comprising:

(a) a tub for receiving such waste paper products and water to a predetermined maxmimum level,
(b) a rotor mounted for rotation in said tub to pulp such waste paper products to aqueous slurry form,
(c) means for extracting from said tub a liquid suspension of small particles of less than a predetermined maximum size,
(d) an outlet in said tub bottom separate from said extracting means,
(e) junk removing means including a casing adjacent said tub and of greater height,
(f) a chute connecting said outlet with said casing and providing for liquid flow between said tub and said casing to carry waste material from said tub into said casing,
(g) an open tank supported in said casing above said maximum liquid level,
(h) means providing an overflow weir from said tank lower than the other walls of said tank,
(i) hopper means positioned to receive liquid slurry flowing over said weir,
(j) conveyor means in said casing for collecting liquid and waste materials and depositing the same in said tank at a sufficient rate to maintain said tank sufficiently full to overflow said weir and thereby to carry floating trash into said hopper while minimizing flow of liquid over other walls of said tank into said casing and thereby reducing the liquid level in said casing with respect to the liquid level in said tub,
(k) coarse screening means positioned in the path of flow over said weir into said hopper to deflect large pieces of waste material laterally while passing liquid and waste pieces smaller than a predetermined maximum size to said hopper, and
(l) means for recycling the resulting slurry of smaller waste materials from said hopper to said pulper tub for further defibering action.

2. Apparatus as defined in claim 1 wherein said recycling means includes means connected to receive slurry from said hopper and to deflake the solid materials therein.

3. Apparatus as defined in claim 2 further comprising means for screening the resulting slurry of deflaked materials to remove undeflaked material therefrom and to recycle the resulting accepted stock to said pulper tub.

4. Apparatus as defined in claim 1 wherein said coarse screening means comprises a plurality of tine members arranged in laterally spaced inclined relation from said weir across said hopper, and further comprising receptacle means positioned to receive pieces of waste material discharged over the lower ends of said tine-like members.

5. Apparatus as defined in claim 4 wherein said coarse screening means comprises a plurality of tine members arranged in laterally spaced inclined relation from said weir across said hopper, and further comprising receptacle means positioned to receive pieces of waste material discharged over the lower ends of said tine-like members, and means for screening said slurry of deflaked materials to remove undeflaked material therefrom and to recycle the resulting accepted stock to said pulper tub.

6. In apparatus for recovering paper making fiber from waste paper products including substantial quantities of plastic film and other lightweight non-paper contaminants, including (a) a tub for receiving such waste paper products and water to at least a predetermined minimum level,
(b) a rotor mounted for rotation in said tub to pulp such waste paper products to aqueous slurry form,
(c) means for extracting from said tub a liquid suspension of small particles of less than a predetermined maximum size,
(d) an outlet in said tub bottom separate from said extracting means,
(e) junk removing means including a casing adjacent said tub and of greater height, and
(f) a chute connecting said outlet with said casing and providing for liquid flow between said tub and said casing,
  (i) the improvement comprising an open tank supported in said casing above said liquid level,
  (ii) means providing an overflow weir from said tank,
  (iii) hopper means positioned to receive liquid slurry flowing over said weir,
  (iv) conveyor means in said casing for collecting liquid and waste materials and depositing the same in said tank at a sufficient rate to maintain said tank sufficiently full to overflow said weir and thereby to carry floating trash into said hopper while minimizing flow of liquid over other walls of said tank into said casing and thereby reducing the liquid level in said casing with respect to the liquid level in said tub,
  (v) coarse screening means positioned in the path of flow over said weir into said hopper to deflect large pieces of waste material laterally while passing liquid and waste pieces smaller than a predetermined maximum size to said hopper, and
  (vi) means for recycling the resulting slurry of smaller waste materials from said hopper to said pulper tub for further defibering action.

7. Apparatus as defined in claim 6 wherein said recycling means comprises means connected to receive slurry from said hopper and to deflake the solid materials therein.

8. The method of operating apparatus for recovering paper making fiber from waste paper products including substantial quantities of plastic film and other lightweight non-paper contaminants which comprises:

(a) a tub for receiving such waste paper products and water to at least a predetermined minimum level,
(b) a rotor mounted for rotation in said tub to pulp such waste paper products to aqueous slurry form,
(c) means for extracting from said tub a liquid suspension of small particles of less than a predetermined maximum size, (d) an outlet in said tub bottom separate from said extracting means, (e) junk removing means including a casing adjacent said tub and of at least the same height, (f) a chute connecting said outlet with said casing and providing for liquid flow between said tub and said casing, (g) an open tank supported in said casing above said maximum liquid level, (h) means providing an overflow weir from said tank lower than the other walls of said tank and leading exteriorly of said casing, and (i) conveyor means in said casing for collecting liquid and waste materials and depositing the same in said tank, which method comprises the steps of (i) operating said conveyor means at a rate sufficient to maintain said tank sufficiently full to overflow along said weir together with lightweight reject materials floating adjacent the top of the liquid in said tank and thereby to carry said floating materials exteriorly of said casing while minimizing flow of liquid over other walls of said tank into said casing and thereby reducing the liquid level in said casing with respect to the liquid level in said tub, (ii) coarsely screening said overflowing slurry to deflect large pieces of waste material laterally therefrom while passing the liquid and waste materials smaller than a predetermined maximum size, and (iii) recycling the resulting slurry of smaller waste materials to said pulper tub for further defibering.

9. The method as defined in claim 8 further comprising the step of collecting and deflaking said slurry from said hopper prior to return thereof to said tub.

10. The method as defined in claim 9 comprising the further step of screening said slurry of deflaked materials to remove undeflaked material therefrom prior to the return thereof to said pulper tub.

* * * * *